United States Patent [19]

Pierson

[11] 3,955,279

[45] May 11, 1976

[54] GUIDE BAR FOR CHAIN SAW HAVING A REPLACEABLE NOSE PORTION

[75] Inventor: William F. Pierson, Oregon City, Oreg.

[73] Assignee: Omark Industries, Inc., Portland, Oreg.

[22] Filed: May 19, 1975

[21] Appl. No.: 578,461

[52] U.S. Cl. ..... 30/384; 83/825

[51] Int. Cl.[2] ..... B27B 17/04

[58] Field of Search ..... 30/383, 384, 385, 386, 30/387; 83/816, 825, 381

[56] References Cited

UNITED STATES PATENTS

| | | | |
|---|---|---|---|
| 2,888,964 | 6/1959 | Mall | 30/384 |
| 2,897,856 | 8/1959 | Carlton | 30/387 |
| 3,602,274 | 8/1971 | Barrett | 83/825 |
| 3,762,047 | 10/1973 | Scott-Jackson | 30/385 |

*Primary Examiner*—Al Lawrence Smith
*Assistant Examiner*—J. C. Peters
*Attorney, Agent, or Firm*—Robert L. Harrington

[57] ABSTRACT

A guide bar has a main portion and a nose portion. The main portion has a convex outer end and the nose portion a mating concave inner end. A tongue extends from the nose portion for insertion in a receiving slot in the main portion and rivets fasten the tongue to the main portion. A relief is formed at the junctions of the edges of the nose portion and main portion, i.e., at the points where the saw chain passes from the main portion to the nose portion and then back to the main portion of the guide bar.

3 Claims, 4 Drawing Figures

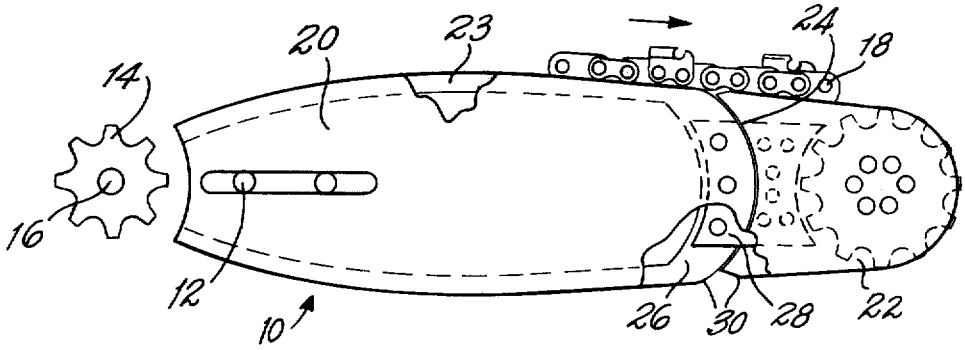
Fig. 1
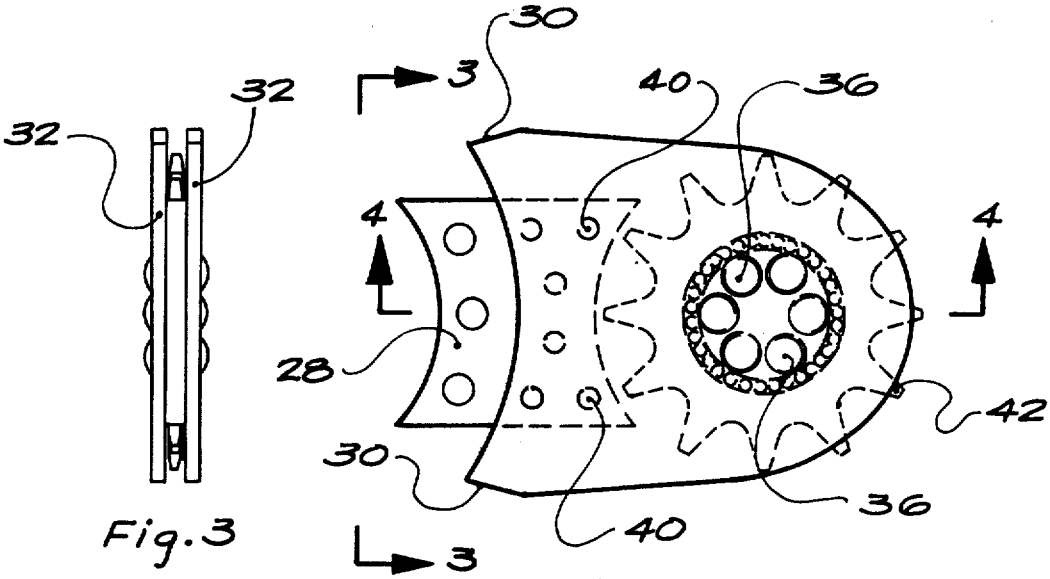
Fig. 3
Fig. 2
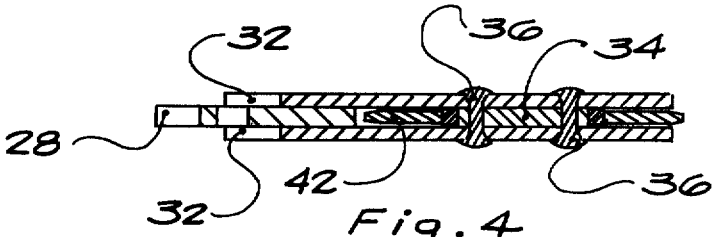
Fig. 4

GUIDE BAR FOR CHAIN SAW HAVING A REPLACEABLE NOSE PORTION

HISTORY OF INVENTION

This invention relates to a guide bar for a chain saw and more specifically to a guide bar having a replaceable nose portion.

A guide bar for a chain saw supports a saw chain that travels at high speeds while subjected to cutting loads. A considerable force is required to pull the chain around the bar and causes a severe wearing of the bar at the nose. Also, it is quite common that bars that are damaged are damaged at the nose portion. Accordingly, this wearing and/or damage at the nose of the bar determines the useable life of the typical guide bar. The bar is a fairly expensive item to the chain saw user. Thus, there have been a number of attempts to design a guide bar having a replaceable nose portion which can double or triple the useability of the main portion of the bar and substantially reduce the users guide bar costs. See for example U.S. Pat. Nos. 2,888,964; 3,602,274; and 2,728,566. A number of disadvantages have been experienced in the use of such prior bars with replaceable nose portions. Because of the high speed at which a saw chain is driven, as it rounds the nose it tends to dig into the bar before it straightens out. A high wearing point is created at this point. The nose portions of the prior bars are convex and this wearing point is located on the main portion of the bar. Secondly, because the chain is being pulled toward the drive sprocket along its bottom edge which is also the normal cutting edge, the greatest pressure of the chain being forced against the bar edge occurs along this lower edge. The junction between the nose and main portions of the bar must be a perfect fit or it exposes an edge that will catch on the chain causing wearing and/or damage. The prior bars accentuate this problem by the concave edge of the main portion of the bar which forms an acute angle facing the chain as it makes the transition from the nose portion.

In the present invention the main portion has a mating edge that is convex and the nose edge is concave. This provides a larger reach of the bar edge that is located on the nose portions encompassing the area wherein the chain converts from the curved path to the straight path. Furthermore, a relief is provided in the edge in both the nose portion and main portion at the point where the two meet. The possibilities of the chain catching on an exposed edge or point is greatly minimized because of the relief and because of the obtuse angle formed at the junction.

Having described the invention in general, a more detailed understanding will be derived by reference to the following detailed description and drawing wherein:

FIG. 1 is a side view of a guide bar in accordance with the present invention;

FIG. 2 is an enlarged side view of the replaceable nose portion of the guide bar shown in FIG. 1;

FIG. 3 is a view taken on lines 3—3 of FIG. 2; and

FIG. 4 is a view taken on section lines 4—4 of FIG. 2.

Referring to the drawings, a guide bar 10 is adapted to be mounted by mounting lugs 12 to a chain saw chassis. A drive sprocket 14 is driven by the drive shaft 16 of the chain saw to drive the saw chain 18 around the guide bar 10.

The guide bar 10 is comprised of a main portion 20 and a nose portion 22. The main portion is provided with a groove 23 formed in its edge in which the drive tangs of the saw chain slide to entrain the saw chain on the edge. The leading or forward edge 24 of the main portion 20 is convexly curved and has a receiving slot 26 for receiving a tongue 28 extending rearwardly from the nose portion 22. A relief 30 is formed at the points of junction with the nose portion 22.

The nose portion 22 is comprised of two plates 32 spaced apart by an inner race member 34 fastened by rivets 36 to the plates 32, and by a tongue 28 fastened to the plates by spot welds 40. The inner race member 34 support an outer race forming a nose sprocket 42 which engages the drive tangs of the chain and aids in passing the chain around the nose. The tongue 28 as previously mentioned extends rearward from the nose portion and is inserted into the slot 26 of the main portion. Riveting the tongue to the main portion thus tightly secures the nose portion to the main portion. A relief 30 is provided at the point of junction with the main portion 20 of the bar and cooperates with the relief 30 in said main portion to eliminate the exposure of an edge to the saw chain passing over the junction.

It will be understood that the invention is applicable to other types of guide bars, as for example to solid nose bars. Thus, the invention is intended to incorporate the scope of the appended claims and is not limited to the specific embodiment shown.

What I claim is:

1. A guide bar for a saw chain comprising; a main portion and a nose portion, said main portion having an outer end edge convexly curved and said nose portion having an inner end edge concavely curved, removable fastening means for removably securing said nose portion to said main portion with said end edges being mated and in abutment, the side edges of the main portion and the nose portion having aligned grooves for receiving the drive tangs of the saw chain to guide the chain along the side edges of the bar, said side edges of the main portion forming obtuse angles with the convex end edges of the main portion, and means at the outer end of said nose portion to guide the saw chain from one side edge of the guide bar around the nose to the other side edge of the guide bar.

2. A guide bar for a saw chain as defined in claim 1 wherein said removable fastening means is comprised of a tongue that extends between the main portion and the nose portion.

3. A guide bar for a saw chain as defined in claim 1 wherein a relief is formed in the edge of the guide bar at the junction between the main portion and the nose portion.

* * * * *